US011140917B2

(12) United States Patent
Neal

(10) Patent No.: US 11,140,917 B2
(45) Date of Patent: Oct. 12, 2021

(54) HUMIDOR

(71) Applicant: Eric Neal, Wauwatosa, WI (US)

(72) Inventor: Eric Neal, Wauwatosa, WI (US)

( * ) Notice: Subject to any disclaimer, the term of this patent is extended or adjusted under 35 U.S.C. 154(b) by 76 days.

(21) Appl. No.: 16/535,544

(22) Filed: Aug. 8, 2019

(65) Prior Publication Data

US 2020/0046018 A1 Feb. 13, 2020

Related U.S. Application Data

(60) Provisional application No. 62/716,592, filed on Aug. 9, 2018.

(51) Int. Cl.
*A24F 25/00* (2006.01)
*A24F 15/08* (2006.01)

(52) U.S. Cl.
CPC ..... *A24F 15/08* (2013.01)

(58) Field of Classification Search
CPC ..... A24F 15/08; A24F 15/00; A24F 15/01; A24F 40/57; A24F 40/95; A24F 23/00; A24F 25/02; A24F 25/00; B65D 85/10
USPC ..... 131/328, 329, 275, 31, 31.1
See application file for complete search history.

(56) References Cited

U.S. PATENT DOCUMENTS

| | | | | |
|---|---|---|---|---|
| 2,860,023 | A * | 11/1958 | Herdlitchka | A24F 25/02 312/31.1 |
| 5,607,051 | A * | 3/1997 | Espinosa | B65D 85/12 206/213.1 |
| 6,068,113 | A * | 5/2000 | Schmaling | A24F 23/00 206/213.1 |
| 6,279,744 | B1 * | 8/2001 | Yu | B25H 3/022 206/372 |
| 6,901,937 | B2 * | 6/2005 | Sebban | A45D 40/221 132/293 |
| 2009/0014019 | A1 * | 1/2009 | Park | A24F 25/00 131/328 |
| 2015/0021217 | A1 * | 1/2015 | Smith | A24F 25/02 206/236 |

* cited by examiner

*Primary Examiner* — King M Chu
(74) *Attorney, Agent, or Firm* — Boyle Fredrickson S.C.

(57) ABSTRACT

A humidor is provided with a body that includes a storage compartment therein that can retain an amount of a smoking material therein. A lid is engaged with the body in a manner to enclose the storage compartment in a manner that protects the smoking material positioned within the compartment. The lid includes a support surface located on one side of the lid that is exposed when the lid is disengaged from the body. The support surface provides an area in which the individual utilizing the smoking material can prepare the smoking material for use in close proximity to the storage container, thus facilitating the use of the smoking material.

6 Claims, 5 Drawing Sheets

HUMIDOR

CROSS-REFERENCE TO RELATED APPLICATIONS

This application claims priority from U.S. Provisional Patent Application Ser. No. 62/716,592, filed on Aug. 9, 2018, the entirety of which is expressly incorporated herein for all purposes.

FIELD OF THE DISCLOSURE

The present disclosure relates generally to humidors, and more specifically to humidors including support structures for utilizing items held in the humidor.

BACKGROUND OF THE DISCLOSURE

In the area of humidors, the primary purpose of the humidor is to provide a container for the proper storage of the materials, such as smoking materials, placed therein. Many humidors are able to provide this function and include compartments for the retention of other items needed to properly utilize the smoking material held within the humidor, such as a cutting device and/or a lighter.

However, these prior art humidors do not provide the user with a support surface on which to prepare the smoking materials for use, or with the ability to enhance the experience of the use of the smoking materials using additional devices, such as electronic devices.

Therefore, it is desirable to develop an improved humidor that can address these issues with the prior art.

SUMMARY OF THE DISCLOSURE

According to one aspect of an exemplary embodiment of the invention, a humidor is provided with a body that includes a storage compartment therein that can retain an amount of a smoking material therein. A lid is engaged with the body in a manner to enclose the storage compartment in a manner that protects the smoking material positioned within the compartment. The lid includes a support surface located on one side of the lid that is exposed when the lid is disengaged from the body. The support surface provides an area in which the individual utilizing the smoking material can prepare the smoking material for use in close proximity to the storage container, thus facilitating the use of the smoking material.

The lid in other exemplary alternative embodiments additionally includes a recess disposed on the periphery of the support surface that is configured to enable a separate device, such as an electronic device, to be positioned and held on the lid at a readily viewable location. Thus, in addition to the support surface for preparing the smoking materials for use, the lid also enables the individual using the humidor to provide an entertainment function for the user.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Before the present compositions, apparatuses and methods are described, it is understood that this invention is not limited to the particular embodiments and methodology, as these may vary. It is also to be understood that the terminology used herein is for the purpose of describing particular exemplary embodiments only, and is not intended to limit the scope of the present invention which will be limited only by the appended claims.

Figure 1:
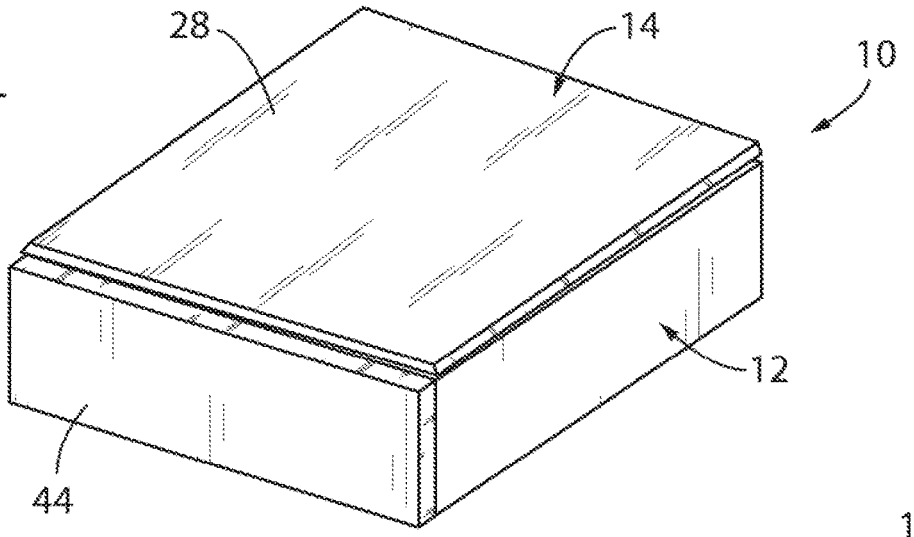
FIG. 1 is an isometric view of a humidor in a closed configuration according to an exemplary embodiment the invention.

Referring now to FIG. 1, the reference numeral 10 generally identifies an illustrated exemplary embodiment of a humidor constructed according to the present disclosure. The humidor 10 can be positioned in either a closed configuration (FIG. 1) or an open configuration (FIG. 2) to provide accessible storage to various smoking materials positioned within the humidor 10.

The humidor 10 includes a body 12, a lid 14 positioned over the body 12 and optionally a locking/support panel 16 connected to the lid 14 and engageable with the body 12.

Figure 3:
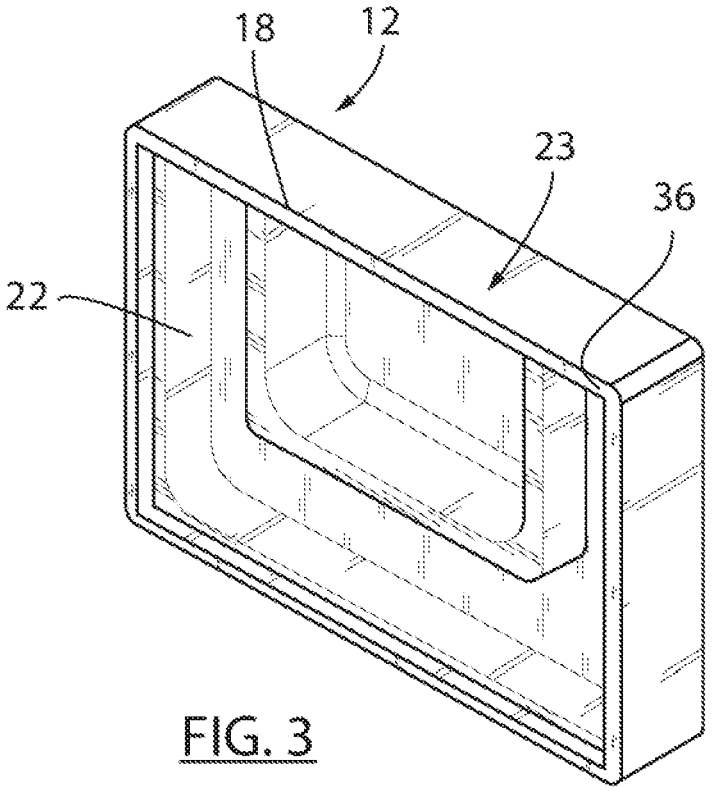
FIG. 3 is an isometric view of a body of the humidor according to an exemplary embodiment the invention.
Figure 4:
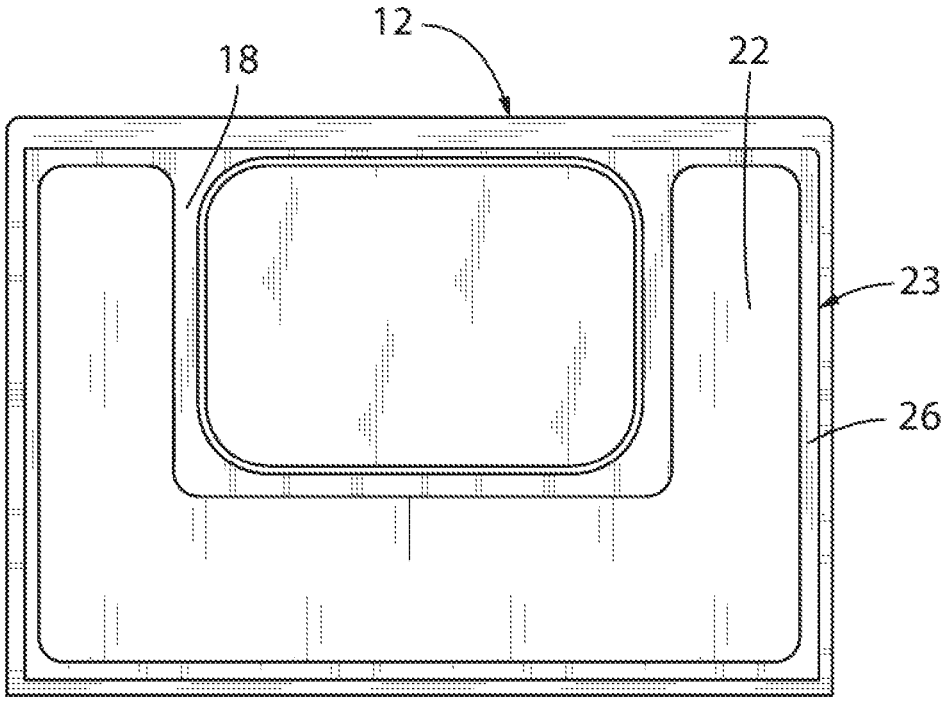
FIG. 4 is a top plan view of the body of FIG. 3.

Referring to FIGS. 3 and 4, the body 12 is formed of any suitable materials, such as plastic, metal or a wood, and is formed with at least one storage compartment 18 therein. The compartment 18 can be integrally formed with the body 12, can be formed separately from the body 12, or can be a separate component 20 that is engaged or positioned within a storage compartment 18 formed on the body 12. In the illustrated exemplary embodiment of FIGS. 3 and 4, the body 12 includes a pair of storage compartments 18 and 22 accessible through an open end 23 of the body. The compartment 18 includes a separate storage container 20 that is disposed therein and which can be separable from the compartment 18 and can include a separate cover 24 engageable with the container 20 to provide a separate closure for the container 20 and the compartment 18.

The compartments 18 and 22 can be sized to accommodate various smoking materials and associated items for use of the material to facilitate the easy access to all of the items necessary for the utilization of the smoking material. Additionally, the compartments 18,22 can be formed as portions of a tray 200 (FIG. 9) that is separable from the container 20 that can be inserted into the interior of the container 20 to provide the desired separation of the interior of the container 20 into the compartments 18,22. The tray 200 can be formed of any desired material and with any configuration desired.

Figure 5:
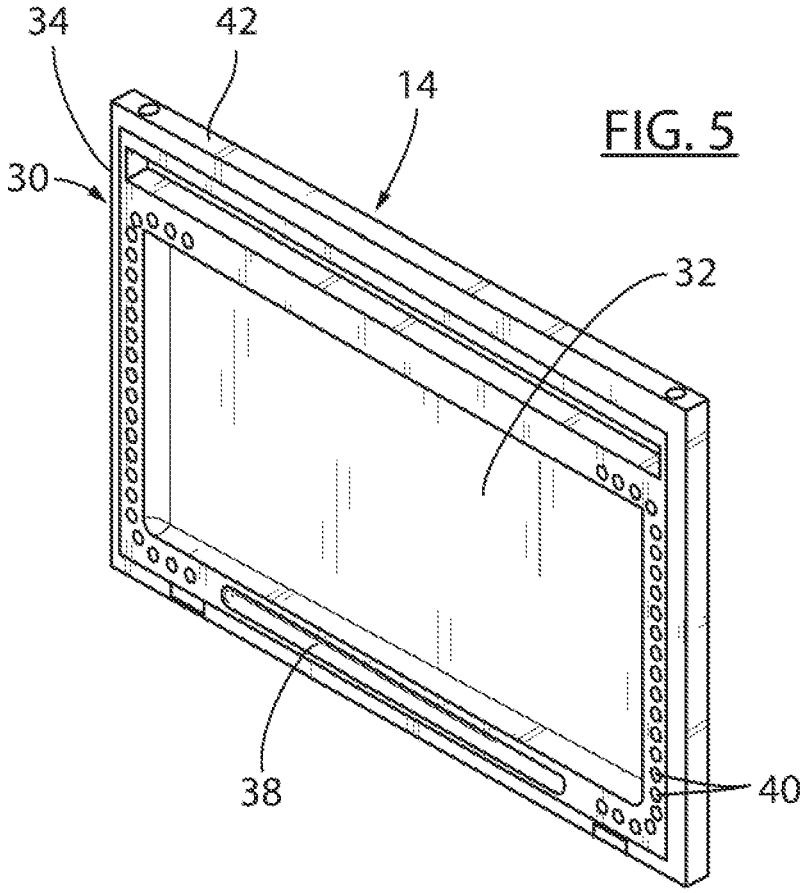
FIG. 5 is an isometric view of a lid of the humidor according to an exemplary embodiment the invention.
Figure 6:
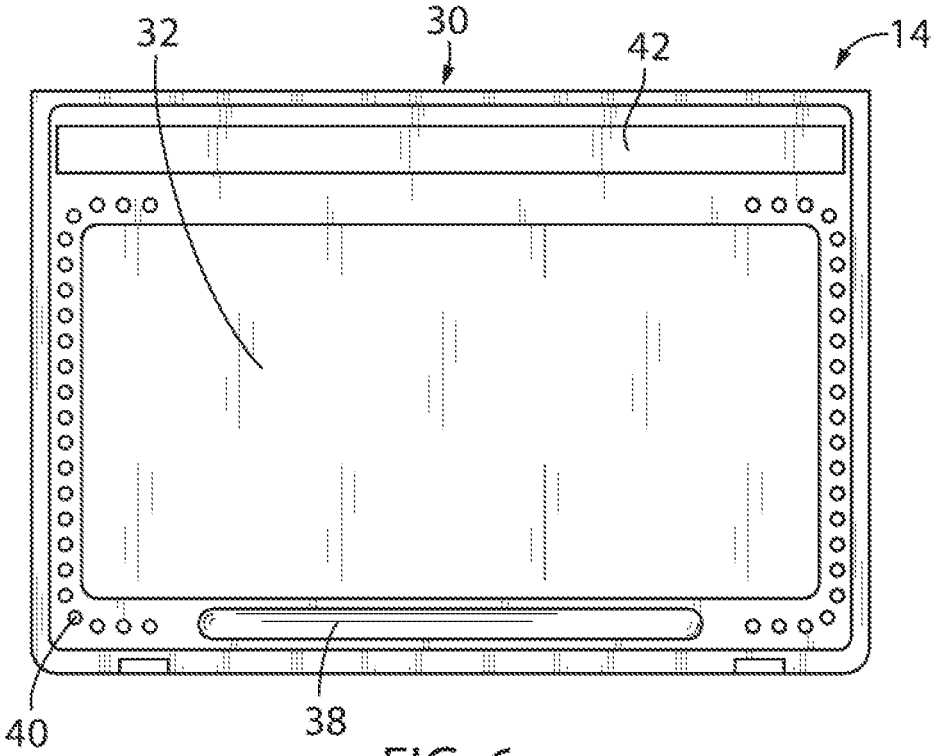
FIG. 6 is a top plan view of the lid of FIG. 5.

To enclose the body 12, referring now to FIGS. 1, 5 and 6, the lid 14 is positioned over the top of the body 12. The lid 14 can be formed of the same or a different material than the body 12, and can be shaped complementary to the body 12 to facilitate the secure positioning of the lid 14 over the body 12. While the lid 14 can be formed completely separate from the body 12, to facilitate the proper positioning of the lid 14 on the body 12 to enclose the smoking material therein, the lid 14 can be attached to the body 12 using hinges 26 or other suitable closure mechanisms.

Looking at FIG. 6, the lid 14 has an upper surface 28 and a lower surface 30. In the closed configuration (FIG. 1) the upper surface 26 of the lid 14 is exposed, while the lower surface 30 is concealed. In the open configuration (FIG. 2) the lower surface 30 is exposed. The lower surface 30 includes a number of features that facilitate the use and enjoyment of the smoking material held within the humidor 10. The central area 32 of the lower surface 30 is formed to be recessed from the outer periphery 34 of the lid 14, which is shaped to nest in a complementary fashion with the edge 36 of the open end 23 of the body 12 to provide a seal between the body 12 and lid 14, optionally in conjunction with a separate or integral sealing member (not shown). The central area 32 provides a location immediately adjacent the storage compartments 18 and 22 where the smoking material and other associated items can be placed for the preparation of the material for use, such as by rolling the material into a cigarette (not shown) or other readily smokeable configuration.

Within the periphery 34 of the lid 14 are disposed a number of additional features. Adjacent the hinges 26, the periphery 34 includes a channel 38 that can readily hold finished cigarettes or other items. Further, the periphery 34 includes a number of bores 40 positioned along the periphery 34 in which different items can be positioned during preparation of the smoking materials within the central area 32.

Opposite the channel 38, the periphery 34 also includes a support recess 42. The support recess 42 is formed with a depth, width and length sufficient to receive an edge 100 of an electronic device 102, such as an iPad®, therein. The recess 42 enable the device to be positioned on the lid 14 in a configuration where the device 102 can be easily viewed by the individual utilizing the central area 32 of the lid 14, thereby providing additional entertainment or video/audio instruction to the individual utilizing the humidor 10.

Figure 2:
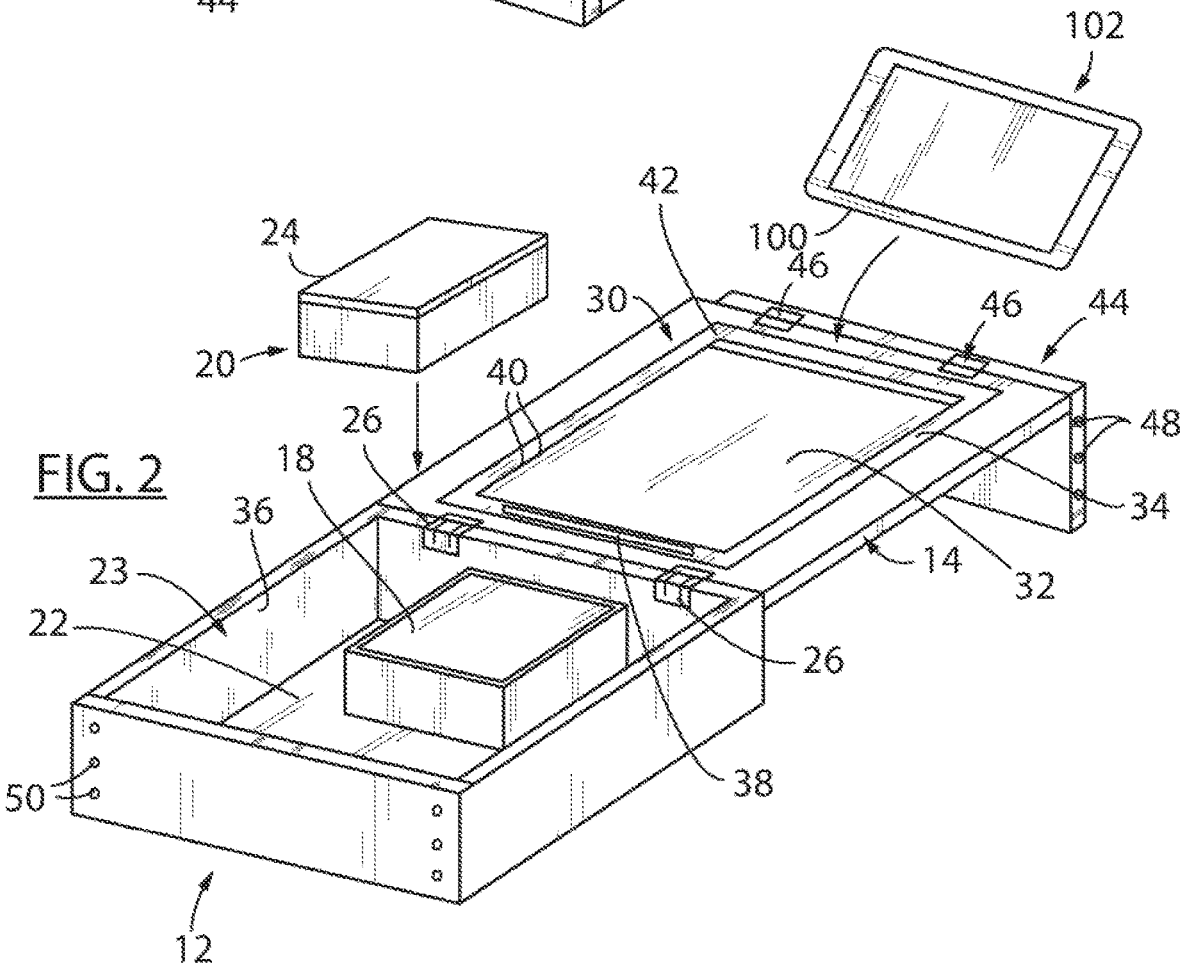
FIG. 2 is an isometric view of a humidor in an open configuration according to an exemplary embodiment the invention.
Figure 7:
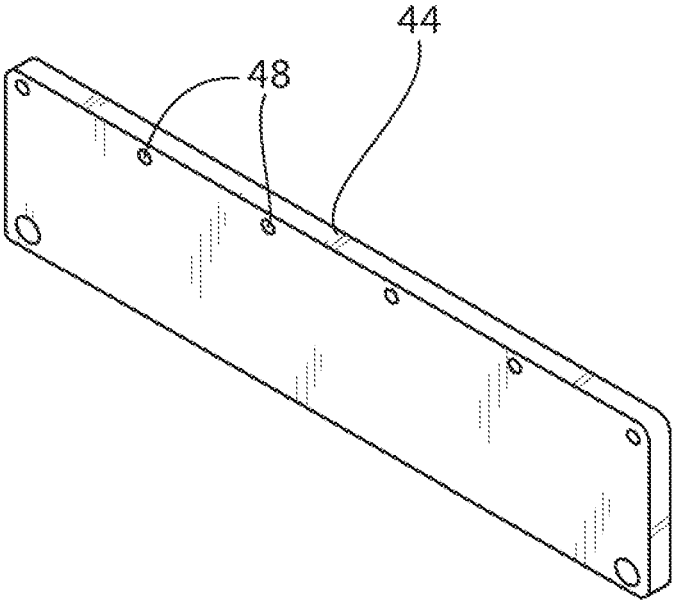
FIG. 7 is an isometric view of a locking/support panel of the humidor according to an exemplary embodiment the invention.
Figure 8:
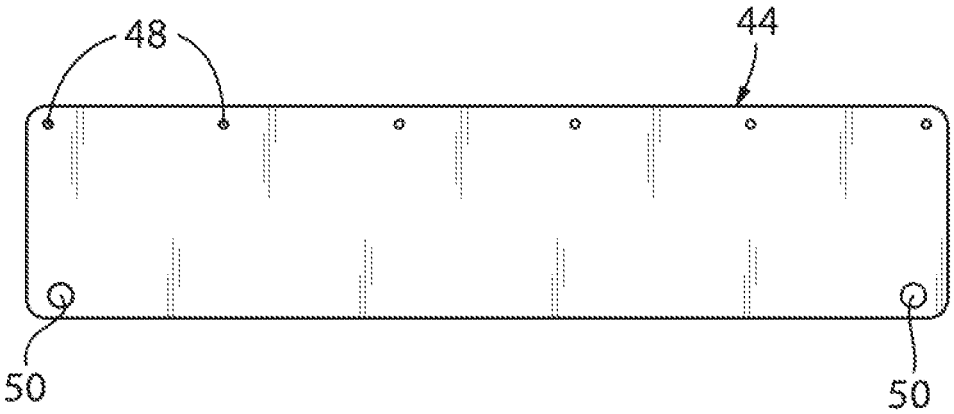
FIG. 8 is a top plan view of the locking/support panel of FIG. 7.

To facilitate the proper positioning of the lid 14 to stably support the device within the support recess 42, the lid 14 can optionally include a locking/support device or panel 44, as shown in FIGS. 2, 7 and 8. The panel 44 is attached to the lid 14 opposite the body 12 in any suitable manner, such as by hinges 46, to enable the panel 44 to pivot with regard to the lid 14. In the open configuration of FIG. 2, the panel 44 is pivoted to be positioned vertically beneath or immediately adjacent the lid 14 and provide support to the edge of the lid 14 opposite the body 12. In this manner, the panel 44 supports not only the lid 14 to facilitate use of the central area 32, but the device 102 disposed within the recess 42 when in use.

Further, the panel 44 can be pivoted around the lid 14 to enable the panel 44 to be placed below the lid 14 in a position overlapping the front of the body 12, as shown in FIG. 1. In this configuration, the weight of the panel 44 pulls the lid 14 into engagement with the body 12 to facilitate forming a suitable seal between the lid 14 and the body 12.

Additionally, in other exemplary embodiments the panel 44 can include magnets 48 that are disposed in a recessed position in the panel 44 and positionable adjacent metal closures or complementary magnets 50 disposed in the body 12 when the panel 44 is in the overlapping position. In this embodiment, the magnets 48 pull the panel 44 into engagement with the body 12, thereby enhancing the seal and closure between the body 12 and the lid 14.

In other alternative embodiments, the magnets 48 can be disposed in the lid 14, e.g., when the panel 44 is omitted.

Figure 9:
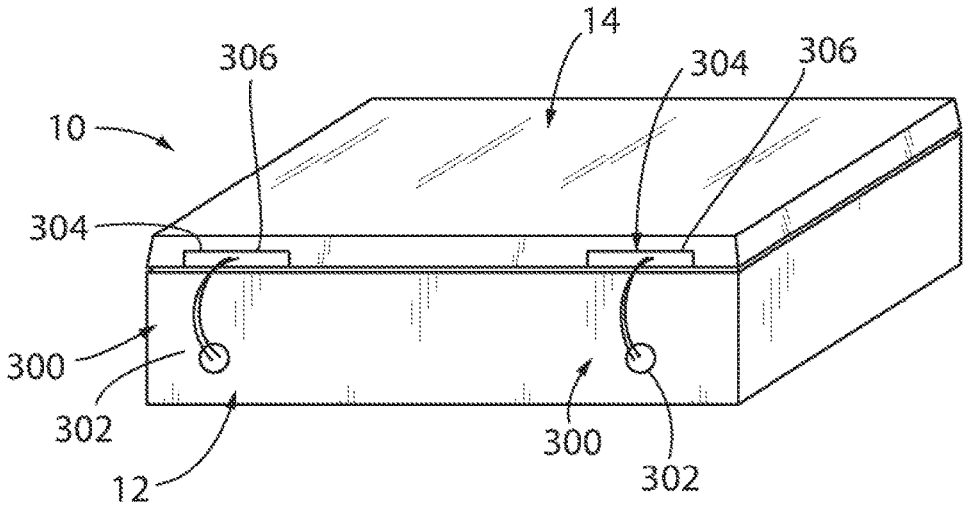
FIG. 9 is an isometric view of a humidor in a closed configuration according to an exemplary embodiment of the invention.
Figure 10:
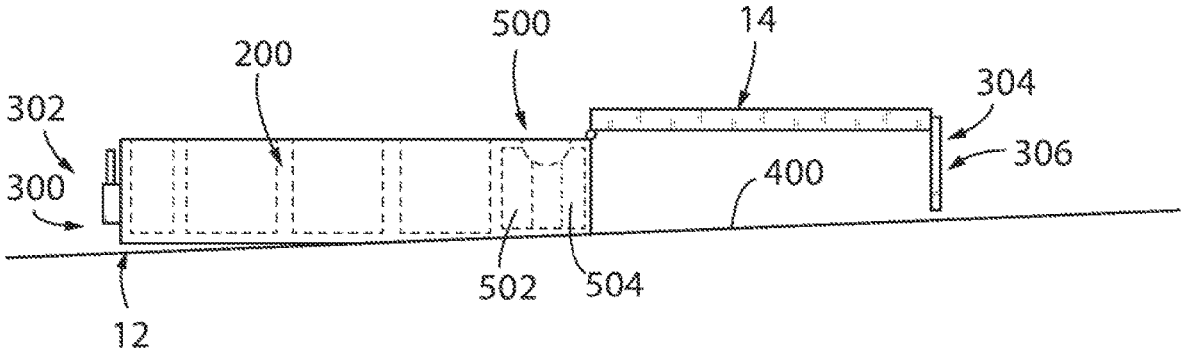
FIG. 10 is a side plan view of the humidor of FIG. 9 in an open configuration.

In still other exemplary embodiments of the invention as shown in FIGS. 9 and 10, the panel 44 can be replaced with a locking/support device or mechanism 300 located on the humidor 10, with a first portion 302 disposed on the body 12 and a second portion 304 disposed on the lid 14. The second portion 304 can include a pair of supports 306 that are releasably engaged with the first portion(s) 302 in a suitable manner, such as an over center cam lock mechanism, among others, to secured the lid 14 to the body 12. When disengaged, the lid 14 can be pivoted away from the body to the position shown in FIG. 10. As the supports 306 are pivotally attached to the lid 14, the supports 306 can move from the horizontal position of FIG. 9 into a vertical position as shown in FIG. 10 where the supports 306 function to position the lid 14 generally horizontally over the surface 400 on which the humidor 10 is positioned.

In still another exemplary embodiment, the body 12 can include a speaker 500. As best shown in the exemplary illustrated embodiment of FIG. 10, the speaker 500 can be disposed within a portion of the tray 200 and can include a power source 502 and a transceiver 504 in order to enable the speaker 500 to wirelessly or wired connect to a music playing device, such as the electronic device 102, in order to provide sound from the humidor 10. The speaker 500 can be formed to be removable from the humidor 10.

Various other embodiments of the present invention are contemplated as being within the scope of the filed claims particularly pointing out and distinctly claiming the subject matter regarded as the invention.

I claim:

1. A humidor comprising:

a) a body;

b) lid releasably attached to the body and including at least one recess in a lower surface of the lid; and c) a locking/support mechanism attached between the lid and the body, wherein the locking/support mechanism includes a first portion secured to the body and a second portion secured to the lid, and wherein the second portion is pivotally secured to the lid to support the lid in a horizontal position when the humidor is in an open configuration; and d) a locking/support panel attached to the lid and releasably engageable with the body, wherein the locking/support panel supports the lid in a horizontal position when the humidor is in an open configuration.

2. The humidor of claim 1 further comprising a tray disposed within the body.

3. The humidor of claim 1 further comprising a speaker disposed within the body.

4. The humidor of claim 1 wherein the at least one recess on the lower surface of the lid is adapted to receive an electronic device therein.

5. The humidor of claim 1 further comprising a storage container disposed within the body.

6. A method for supporting a lid relative to a body of a humidor, the method comprising the steps of:

a) providing a humidor including a body, a lid releasably attached to the body and including at least one recess in a lower surface of the lid and a locking/support device attached to the lid and releasably engageable with the body; a locking/support panel attached to the lid and releasably engageable with the body;

b) disengaging the locking/support device from the body;

c) pivoting the lid with respect the body; and d) positioning at least a portion of the locking/support device beneath the lid opposite the body; and wherein the locking/support panel supports the lid in a horizontal position when the humidor is in an open configuration.

* * * * *